US005267892A

United States Patent [19]

Takemoto et al.

[11] Patent Number: 5,267,892

[45] Date of Patent: Dec. 7, 1993

[54] TOKEN MANAGEMENT SYSTEM FOR SLOT MACHINE ISLAND

[75] Inventors: Takatoshi Takemoto; Keizo Kasahara, both of Tokyo; Meiji Muramatsu, Yokohama, all of Japan

[73] Assignee: Kabushiki Kaisha Ace Denken, Tokyo, Japan

[21] Appl. No.: 937,851

[22] PCT Filed: Jan. 24, 1992

[86] PCT No.: PCT/JP92/00063

§ 371 Date: Oct. 15, 1992

§ 102(e) Date: Oct. 15, 1992

[87] PCT Pub. No.: WO92/14524

PCT Pub. Date: Mar. 9, 1992

[30] Foreign Application Priority Data

Feb. 19, 1991 [JP] Japan ..... 3-023640

[51] Int. Cl.[5] ..... G07F 17/34

[52] U.S. Cl. ..... 453/16; 453/56

[58] Field of Search ..... 453/16, 17, 56, 57

[56] References Cited

U.S. PATENT DOCUMENTS

| | | | |
|---|---|---|---|
| 4,342,384 | 8/1982 | Fukase et al. | 221/9 X |
| 5,067,928 | 11/1991 | Harris | 453/17 |
| 5,100,367 | 3/1992 | Abe | 453/57 X |

FOREIGN PATENT DOCUMENTS

| | | |
|---|---|---|
| 55-166286 | 11/1980 | Japan . |
| 57-1375 | 1/1982 | Japan . |
| 62-200381 | 12/1987 | Japan . |
| 1-129866 | 5/1989 | Japan . |

*Primary Examiner*—F. J. Bartuska

*Attorney, Agent, or Firm*—Lowe, Price, LeBlanc & Becker

[57] ABSTRACT

A token management system for a slot machine has a buffer tank communicating with a token counter and a collection conveyer, and also has a token polisher for continuously raising tokens in the buffer tank to a hopper while polishing the tokens. A main tank receives overflow tokens from the hopper, and supplies the tokens to the buffer tank when the hopper is empty.

2 Claims, 2 Drawing Sheets

TOKEN MANAGEMENT SYSTEM FOR SLOT MACHINE ISLAND

FIELD OF TECHNOLOGY

This invention relates to a token management system for a slot machine island. In the slot machine island, tokens counted by a token counter or to be collected from the individual slot machine are re-supplied to the slot machine while being polished. This invention relates to a token management system capable of controlling such flow of tokens in the slot machine island.

BACKGROUND TECHNOLOGY

A slot machine island is currently known in which a token polisher is connected vertically from a tank communicating with a token counter and a collection conveyer and in which tokens can be supplied to a supply conveyer from a hopper communicating with an upper portion of the token polisher.

In such slot machine islands, practically, the tokens obtained from one island may be conveyed to any other nearby island where the tokens may be counted by a token counter associated therewith. However, in the conventional slot machine island, since the capacity of the tank is predetermined and limited to a specific quantity of tokens which are to be used within each island, the tank might become full when the tokens obtained from another island are inserted into the island associated with the token counter, so that counting is stopped, which causes inconvenience to a player.

DISCLOSURE OF THE INVENTION

With the foregoing problems in view, it is an object of this invention to perform token management comfortably in each island. For this purpose, there is provided a token management system for a slot machine island, comprising a buffer tank communicating with a token counter and a collection conveyer, a token polisher vertically mounted from the buffer tank, a hopper communicating with the token polisher at its upper portion for supplying tokens to a supply conveyer, a main tank for receiving the tokens from the hopper when the hopper is filled with tokens, communicating with the buffer tank which is normally being constantly emptied, but is supplied with tokens from the main tank upon becoming empty.

The main tank may include a plurality of main tank units communicating with the hopper and the buffer tank.

With this arrangement, the tokens to be counted by the token counter or to be collected from the slot machine are fed to the token polisher where the tokens are raised to the hopper from the buffer tank while being polished. Then the tokens are supplied from the hopper to the individual slot machines. When the hopper is full, overflow tokens are supplied to and stored in the main tank. When the hopper becomes empty, it is possible to supply the tokens from the main tank to the buffer tank. Since the tokens supplied to the buffer tank are raised and polished by the token polisher, it is possible to keep the tank normally empty and therefore it is possible to satisfy the player's demands at all times without stopping the use of the token counter.

PREFERRED EMBODIMENTS OF THIS INVENTION

Figure 1:
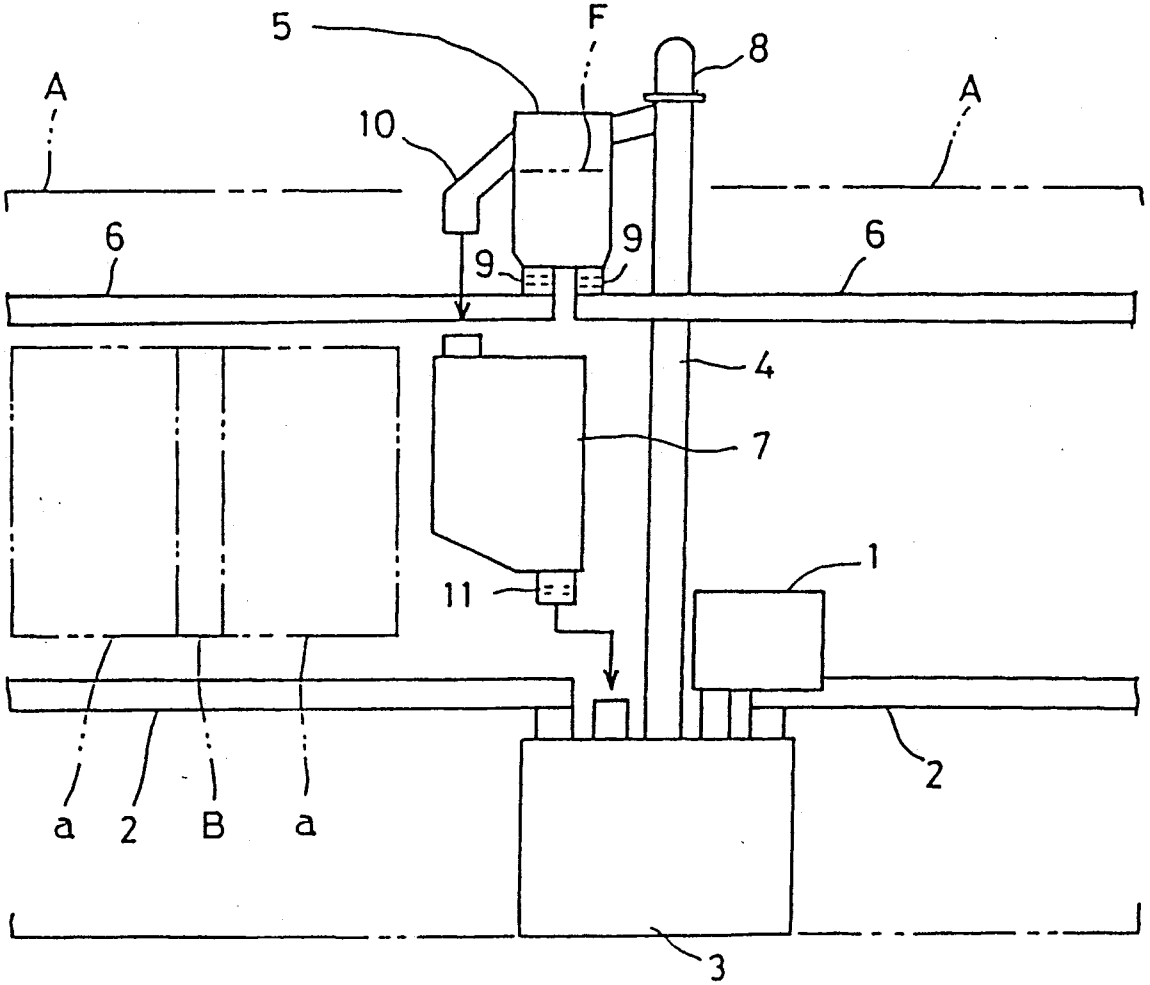
FIG. 1 is a token management system, for a slot machine island, according to a first embodiment of this invention.

In FIG. 1, reference character A designates a slot machine island composed of a pair of parallel arrays facing opposite directions, each array including a plurality of slot machines a, and a plurality of intermachine token dispensers B, disposed adjacent to the slot machines a. A supply conveyer 6, for supplying the tokens to the individual slot machines a, and the intermachine token dispensers B, and a collection conveyer 2, for conveying the tokens to be discharged, extend respectively through the upper and lower portions of the slot machine island A.

The slot machine island A is equipped with a token counter 1 for counting the inserted tokens and for issuing a receipt or a card according to a counted value. In the lower part of the inside of the slot machine island A, there is equipped a buffer tank 3 communicating with the token counter 1 and the collection conveyer 2. A token polisher 4 to be driven by a motor 8 extends upwardly from the buffer tank 3. In the upper part of the slot machine island A, there is disposed a hopper 5 communicating with an upper portion of the token polisher 4. The lower portion of the hopper 5 is connected to supply passageways 9, 9 which are normally closed and are openable, in response to a supply signal from the supply conveyer 6, to communicate with the supply conveyer 6.

A main tank 7 is mounted in the slot machine island A; the lower portion of an outflow gutter 10 is connected with the upper portion of the main tank 7, so that the tokens may overflow when the hopper 5 is full as indicated by an imaginary line F in FIG. 1. The lower portion of the main tank 7 is provided with a delivery passageway 11 which is normally closed and is openable only when the hopper 5 becomes empty, and the lower portion of the delivery passageway 11 communicates with the upper portion of the buffer tank 3.

The tokens collected from the token counter 1 or the slot machine via the collection conveyer 2 are received in the buffer tank 3 and, immediately thereafter, are raised into the hopper 5 while being polished. When the hopper 5 becomes empty due to continuous supply of the tokens from the hopper 5, the tokens in the main tank 7 are supplied to the tank 3. The thus supplied tokens are, as described above, raised into the hopper 5 while being polished by the polisher 4. Since the tokens supplied into the buffer tank 3 are raised without interruption, the buffer 3 is normally kept virtually empty. Therefore it is possible to always receive the tokens collected by the collection conveyer or inserted via the token counter, thus avoiding any possibility of stopping the use of the token counter.

Figure 2:
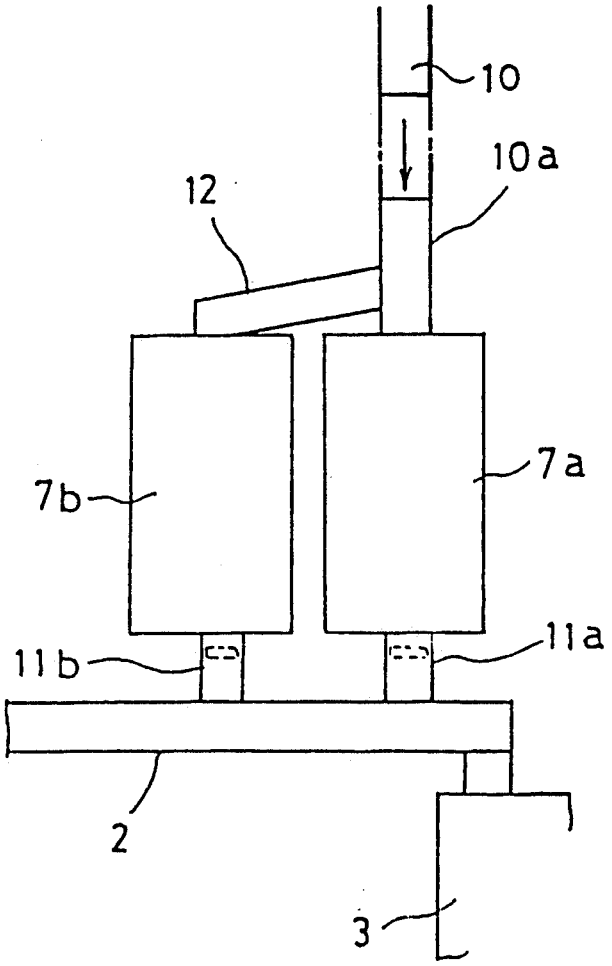
FIG. 2 shows a second embodiment.

FIG. 2 shows a second embodiment; parts or elements similar to those of the first embodiment are designated by like reference numerals. The second embodiment is identical in construction with the first embodiment, except that it includes a pair of parallel main tanks 7*a*, 7*b*. A supply gutter 10*a* communicating with the lower portion of the outflow gutter 10 extends over one of the main tanks 7*a*. A supply gutter 12 extends between the lower portion of the supply gutter 10*a* and the upper portion of the other main tank 7*b*, and delivery passageways 11*a*, 11*b* associated with the respective lower portions of the two main tanks 7*a*, 7*b* are connected with the collection conveyer 2.

With this arrangement, when the tokens counted by the token counter 1 and/or collected from the individual slot machine a, via the collection conveyer 2 are supplied into the tank 3, they are then raised to the hopper 5 while being polished by the token polisher 4. From the hopper 5, tokens are discharged to the individual slot machine a, and/or the individual token dispenser B according to a supply signal from the supply conveyer 6. When the hopper 5 becomes full with continued supplying of tokens from the token polisher 4, overflow tokens will be supplied to and stored in the main tank 7. When the hopper 5 becomes empty, the tokens in the main tank 7 will then be supplied to the tank 3 and then to the hopper 5. Thus it is possible to keep the tank 3 normally empty.

USEFULNESS OF THE INVENTION

According to this invention, since the tank 3 can be kept normally empty by the provision of the main tank 7, it is possible to smoothly accept the insertion of tokens, without stopping the use of the token counter 1 as often happens conventionally. Therefore, the token counter 1 can always be used, irrespective of whether or not any excessive tokens are brought to the island from another island.

We claim:

1. A token management system for a slot machine island, comprising:

a token counter for counting tokens in response to insertion of tokens gained by a player;

a collection conveyer communicating with individual slot machines in the slot machine island for collecting tokens inserted into the individual slot machines;

a buffer tank communicating with said token counter and said collection conveyer;

a vertical polisher communicating with said buffer tank for raising the tokens in said buffer tank while polishing the tokens;

a hopper communicating with said token polisher at its upper portion;

a supply conveyer for receiving the tokens from said hopper and supplying them to the individual slot machines; and a main tank for receiving the tokens from said hopper, when said hopper is filled with the tokens, and for supplying the tokens in said main tank to said buffer tank only when said hopper is empty.

2. A token management system according to claim 1, wherein said main tank includes a plurality of main tank units which is connected to a passageway for receiving the tokens from said hopper, when said hopper is full, and which communicates with said buffer tanks.

* * * * *